United States Patent [19]

Choe

[11] Patent Number: 4,508,222

[45] Date of Patent: Apr. 2, 1985

[54] PLASTIC BAGS

[75] Inventor: Francis S. O. Choe, Singapore, Singapore

[73] Assignee: 501 Lamipak Industries (Europe) Ltd., London, England

[21] Appl. No.: 586,338

[22] Filed: Mar. 5, 1984

[30] Foreign Application Priority Data

Mar. 16, 1983 [GB] United Kingdom ..... 8307213

[51] Int. Cl.[3] ..... B65D 30/10; B65D 33/00

[52] U.S. Cl. ..... 206/390; 383/120; 220/407; 220/410; 493/267; 493/186

[58] Field of Search ..... 206/390; 383/120; 220/410, 407; 493/186, 267

[56] References Cited

U.S. PATENT DOCUMENTS

| | | | |
|---|---|---|---|
| 2,819,834 | 1/1958 | Brady | 383/120 |
| 2,915,098 | 12/1959 | McKay, Jr. et al. | 383/120 |
| 3,349,991 | 10/1967 | Kessler | 383/120 |
| 3,758,024 | 9/1973 | Bethke et al. | 383/120 |

*Primary Examiner*—William T. Dixson, Jr.
*Attorney, Agent, or Firm*—Bacon & Thomas

[57] ABSTRACT

A thermoplastic bag (7) having a gusset (3) on one side only, the gusseted side (5) and ungusseted side (6) being completely or partially folded over one another along a longitudinal axis (4) and sealed together (8) across the bottom of the bag.

12 Claims, 3 Drawing Figures

PLASTIC BAGS

This invention concerns plastic bags and their manufacture and is particularly concerned with the manufacture of garbage bags.

The invention thus provides a thermoplastic bag having a gusset on one side only, the gusseted and ungusseted sides being completely or partially folded over one another along a longitudinal axis and sealed together across the bottom of the bag.

The combination of the gusset and the folding results in there being six layers of the bag material sealed together along at least part of the bottom of the bag. This creates a strong seal and the bags are thus particularly suitable for use as garbage bags. Moreover, the design of the bags enables them to be mass produced economically, particularly in comparison with bags of similar size having gussets on both sides.

The bags may be made of any suitable thermoplastic sheet material and are preferably made of a heat-sealable material, e.g. a polyolefin such as polyethylene. The thickness of the material is generally in the range 0.004–0.1 mm.

The depth of the gusset is preferably such that the gusseted and ungusseted sides of equal or approximately equal width. This enables the gusseted and ungusseted sides to be folded completely or substantially completely over one another, (i.e. along the longitudinal centre line), so that six layers of material can then be sealed together across the whole or substantially the whole width of the bottom of the bag. It will be appreciated that this particular design requires one third of the width of the bag to be folded inwardly to form the gusset.

Alternatively however the depth of the gusset may be such that the gusseted and ungusseted sides are not equally wide, and for example a shallower gusset may be used. In this case, when the gusseted bag is folded along its centreline and sealed, there is one portion where six layers are sealed together and another portion where only four layers are sealed together. Again, the bag may be folded off-centre, and this again results in six layers being sealed together along one portion of the bottom and four layers being sealed together along a second portion.

The invention also includes a method for the manufacture of a bag as defined above, which comprises forming a tube of a thermoplastic sheet material having a gusset along one side only, completely or partially folding the gusseted and ungusseted sides over one another along a longitudinal axis and transversely sealing the folded tube to form the bag bottom.

The tube of sheet material used in this method may be produced in various ways and for manufacturing convenience will almost always be in the form of a continuous length, e.g. taken from a roll or direct from an extruder. For example, layflat tubing of appropriate width may be used or tubes may be formed by cutting and sealing two superimposed sheets. In another method, a sheet of layflat tubing is longitudinally cut and sealed (e.g. with a heat sealing knife) to form two or more tubes which are then gusseted, folded and sealed as indicated above. Layflat tubing of standard width can for example be used by this method to produce six to eight tubes of appropriate width for garbage bag manufacture.

In a further method, a sheet of tubing is first gusseted on both sides and then longitudinally cut and sealed.

The two gusseted tubes so-formed are then folded and transversely sealed as indicated above. This method has certain production advantages, particularly as compared to the production of bags gusseted on both sides; for example, it allows for the production of twice as many bags while using essentially similar equipment. Thus, the inventions also includes a method for the manufacture of a bag of the invention, which comprises forming gussets along both sides of a tube of a thermoplastic sheet material; longitudinally cutting and sealing the tube to form two tubes gusseted along one side only; completely or partially folding the gusseted and ungusseted sides of each tube over one another along a longitudinal axis; and transversely sealing each folded tube to form the bag bottom. Layflat tubing of appropriate width taken direct from an extruder is preferably used in this method and this has the advantage that intermediate rolling is not necessary. Tubing can however also be cut from wider layflat tubing or formed from separate sheets, as indicated above.

After the bag has been formed from a continuous length of tubing, it is severed transversely from the tubing and this may be done after or simultaneously with the formation of the bottom seal. The finished bag is in folded form and for use the top of the bag is opened out while the bag walls remain gathered together by the seal at the bottom.

As an alternative to severing the bags from the tubing, a line of weakness (e.g. a perforation) can be formed transversely, adjacent to the transverse seal. The bags can then be sold in the form of a roll or length of bags joined together at their ends, from which individual bags are separable by the user along the line of weakness.

An example of a bag of the invention is shown in the accompanying drawing in which:

FIG. 1 shows a partially formed bag (1) formed from a tube of a thermoplastic sheet material by inwardly folding one longitudinal edge (2) to form a gusset (3). The gusset (3) extends to the longitudinal centre line (4) to give a gusseted side (5) and ungusseted side (6) of equal width.

Figure 1:
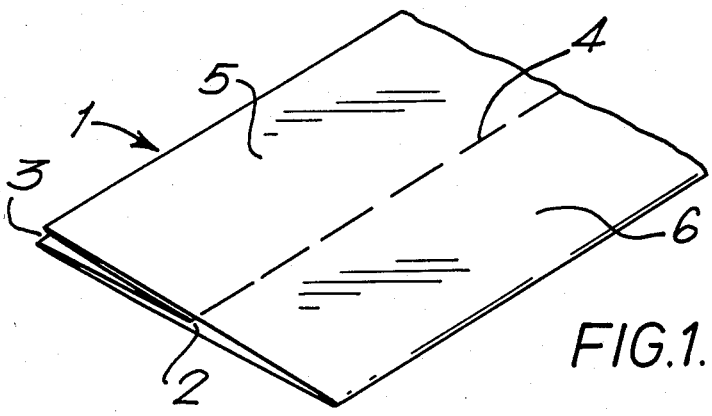
FIGS. 1 and 2 are perspective views of partially formed bags.
Figure 2:
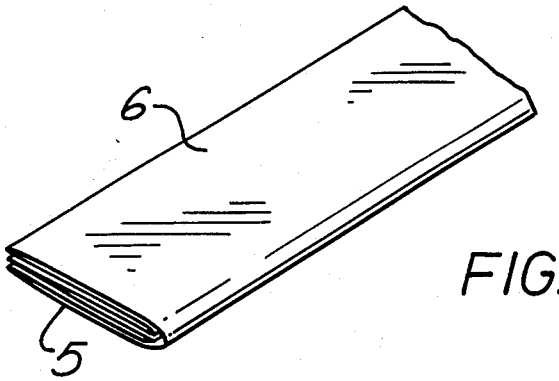
Figure 3:
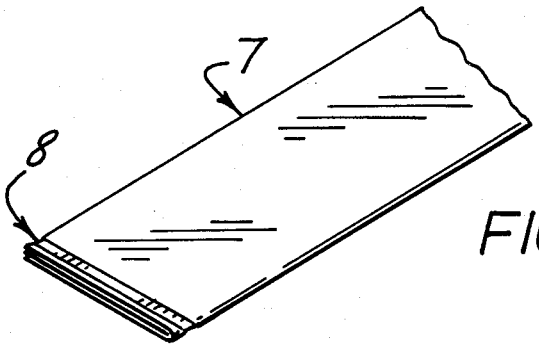
FIG. 3 is a perspective view of a finished bag.

As shown in FIG. 2, the bag (1) is then folded in half along the centre line (4), so that the ungusseted side (6) is completely folded over the gusseted side (5). The bag is then finished by heat sealing the layes together across the bottom, and FIG. 3 shows a finished bag (7) and the transverse bottom heat seal (8).

Although only a single bag is shown for clarity in the drawing, it will be appreciated that in actual manufacture the gusseting, folding and sealing operations are normally applied to a continuous length of thermoplastic tubing and the finished bag is then severed from the tubing.

I claim:

1. A thermoplastic bag having a gusset on one side only, the gusseted and ungusseted sides being completely or partially folded over one another along a longitudinal axis and sealed together across the bottom of the bag.

2. A bag as claimed in claim 1 wherein the gusseted and ungusseted sides are of equal or approximately equal width.

3. A bag as claimed in claim 2 wherein the gusseted and ungusseted sides are completely or substantially completely folded over one another along the longitudinal centre line of the bag.

4. A bag as claimed in claim 1 which is made of a polyolefin.

5. A bag as claimed in claim 1 in the form of a roll or other continuous length of such bags joined together at their ends, individual bags being separable from the roll or length along a line of weakness adjacent to the transverse seal at the bottom of the bag.

6. A method for the manufacture of a bag as claimed in claims 1, which comprises forming a tube of a thermoplastic sheet material having a gusset along one side only, completely or partially folding the gusseted and ungusseted sides over one another along a longitudinal axis and transversely sealing the folded tube to form the bag bottom.

7. A method as claimed in claim 6 wherein the tube is layflat tubing of appropriate width or is formed by longitudinally cutting and sealing a wider sheet of layflat tubing before gusseting, to form two or more tubes.

8. A method as claimed in claim 6 which comprises forming gussets along both sides of a tube of a thermoplastic sheet material; longitudinally cutting and sealing the tube to form two tubes gusseted along one side only; completely or partially folding the gusseted and ungusseted sides of each tube over one another along a longitudinal axis; and transversely sealing each folded tube to form the bag bottom.

9. A method as claimed in claim 8 wherein the tube is layflat tubing.

10. A method as claimed in claim 8 wherein the gusseted and ungusseted sides of the tube gusseted on one side only are of equal or approximately equal width.

11. A method as claimed in claim 10 wherein the gusseted and ungusseted sides are completely or substantially completely folded over one another along the longitudinal centre line of the tube.

12. A method as claimed in claim 6 wherein a continuous length of tubing is used to form the bag and the bag is severed transversely from the length after or simultaneously with the formation of the bottom seal.

* * * * *